United States Patent [19]

Spink

[11] 4,362,438

[45] Dec. 7, 1982

[54] SUPPORTING DEVICE

[75] Inventor: Ian R. Spink, Hvalstad, Norway

[73] Assignee: A/S Akers Mek. Verksted, Oslo, Norway

[21] Appl. No.: 193,637

[22] Filed: Oct. 3, 1980

[51] Int. Cl.[3] ..... E21B 43/01

[52] U.S. Cl. ..... 405/195; 60/413; 166/355; 254/277

[58] Field of Search ..... 405/195–198, 405/202–209, 168–171; 175/5–9, 27; 114/264, 258, 265; 60/413; 254/271, 277, 337; 267/125; 166/355, 350, 359, 367

[56] References Cited

U.S. PATENT DOCUMENTS

| | | | |
|---|---|---|---|
| 3,158,208 | 11/1964 | Kammerer | 175/27 |
| 3,718,316 | 2/1973 | Larralde et al. | 254/277 |
| 3,793,835 | 2/1974 | Larralde | 60/413 |
| 3,902,319 | 9/1975 | Olmsted | 60/413 |
| 3,905,580 | 9/1975 | Hooper | 60/413 |
| 3,912,227 | 10/1975 | Meeker et al. | 175/5 X |
| 3,946,559 | 3/1976 | Stevenson | 254/277 X |
| 4,004,532 | 1/1977 | Reynolds | 114/256 |
| 4,176,722 | 12/1979 | Wetmore et al. | 175/27 X |
| 4,213,720 | 7/1980 | Portass | 405/195 |

*Primary Examiner*—Dennis L. Taylor

*Attorney, Agent, or Firm*—Watson, Cole, Grindle & Watson

[57] ABSTRACT

Equipment which extends from a floating structure towards the ocean floor therebelow is supported on the floating structure by a device which includes at least two hydraulic cylinders which are arranged between the floating structure and the equipment, the hydraulic cylinders being connected to a source of hydraulic pressure fluid, and a valve apparatus which is connected via a first conduit to each hydraulic cylinder on the piston rod side of its piston and via a second conduit to each hydraulic cylinder on the opposite side of its piston. The valve apparatus connects the first and second conduits for each hydraulic cylinder under normal conditions, but under deviant pressure conditions in one hydraulic cylinder breaks the connection between the first and second conduits of the other hydraulic cylinders and connects their first conduits with the first and second conduits of the deviant hydraulic cylinder.

4 Claims, 7 Drawing Figures

SUPPORTING DEVICE

SUMMARY OF THE INVENTION

The present invention relates to a device for supporting equipment on a floating structure, such equipment preferably extending between the structure and the sea floor, comprising at least two hydraulic cylinders which are arranged between the structure and the equipment and which are connected to a source of hydraulic pressure fluid.

A device of this type is known, i.e., from Norwegian Patent Application No. 78.1415. In this known device the hydraulic cylinders are arranged in pairs, these pairs working in two orthogonal planes. The device is utilized to support a riser pipe extending between a well-head on the sea floor and a floating structure which is anchored above the well-head for production of oil from the well. Regardless of how the floating structure is anchored, it will have to move under the influence of waves, wind and current. The supporting device must therefore permit the riser pipe to perform both axial and pendulus motions with respect to the floating structure.

The supporting device must also exert a certain tension on the riser piper. The riser pipe is in fact so long and heavy that if it was permitted to rest on the well-head with its entire weight, the well-head would be subjected to destructive overloading and, besides, the riser pipe would probably collapse. In order to avoid such destruction and major damage, it is important that the tensional force exerted by the supporting device on the riser pipe be held constant within relatively narrow limits. Thus, one cannot tolerate one of the hydraulic cylinders in the supporting device malfunctioning without a concurrent increase in the supporting force from the remaining cylinders. In previously known devices it has been attempted to obtain this function by providing a control system which, with a reduction of pressure in one of the cylinder pairs, isolates and completely relieves the pressure in this pair, while the other cylinder pairs are coupled from their usual pressure source and are connected with another source giving twice as a high a pressure. Thus, only one cylinder pair will be functioning, but this pair will in return provide twice the force, so that the tension on the riser pipe will be maintained generally unchanged.

However, this known system is burdened with a number of drawbacks and deficiencies. For instance, a certain time will elapse before the control system is able to register the error and perform the necessary switching. Furthermore, additional time will elapse before the remaining cylinder pair is stabilized at a higher pressure level. The pressure energy is supplied by means of pressurized air which acts via a hydropneumatic accumulator arranged for each cylinder, and the pressurized air necessarily needs some time to flow from the source through the necessary lines and valves to finally fill the accumulators. Since time is a very essential factor in this connection, one cannot rely on a conventional compressor as the pressure source but will have to store the compressed air in containers in order for the air to be immediately available. However, the air in these containers must be stored at a pressure which is higher than the final pressure to be obtained in the system because the air will be distributed in a larger volume. Not only is it difficult to calculate what the storage pressure must be, but this pressure will also change from time to time when the floating structure changes position, this also changing the equilibrium position of the supporting device, the result being that the gas volume in the accumulators changes. A further problem with the system is that when the compressed air in the reserve containers expands out into the system for increasing the pressure in the remaining cylinder pair, this expansion takes place generally adiabatically so that a temperature change occurs in the air in the system. After some time, however, this temperature difference will be equalized due to heat transfer with the surroundings, the result being a gradual change in the pressure of the system until thermal equilibrium has been reached.

The function of the known device is also dependent on the proper functioning of its control system. This control system comprises a number of components which may fail or malfunction, thus reducing the reliability of the device. In addition to the control system being complicated and costly, it will require comprehensive maintenance work and frequent and difficult functional testing. Despite the complicated nature of the known device, it is not certain that it will be able to react fast enough to prevent damage to the supported equipment.

SUMMARY OF THE INVENTION

It is the object of the invention to provide a device of initially mentioned type which is not burdened with the above-mentioned drawbacks and deficiencies.

According to the present invention a supporting device is provided which is characterized in that it also includes a valve means which for each of the cylinders is connected via a first conduit to the hydraulic cylinder on the piston rod side of its piston and via a second conduit is connected with the hydraulic cylinder on the opposite side of the piston, the valve means being arranged, under normal pressure conditions, to connect the first and second conduits for each hydraulic cylinder and, under deviant pressure conditions in one of the hydraulic cylinder, to break the connection between first and second conduits for the remaining hydraulic cylinders and connect the first conduits of these with the first and second conduits of the deviant hydraulic cylinder, and in that the area of the piston of each hydraulic cylinder on the piston rod side is equal to its area on the opposite side divided by the number of hydraulic cylinders connected to the valve means.

Further advantageous features of the invention will appear from the following description of the examplifying embodiment of the invention shown schematically in the appended drawings.

DETAILED DESCRIPTION OF THE PREFERRED EMBODIMENTS

Figure 1:
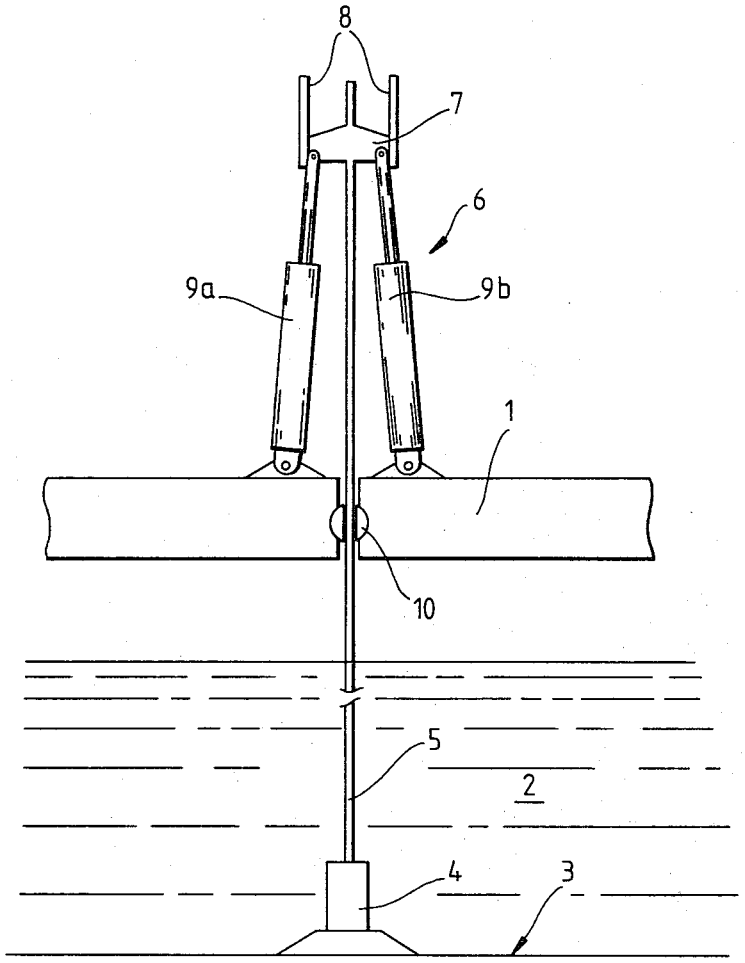
FIG. 1 shows schematically a part of a floating structure equipped with the device according to the invention.

FIG. 1 shows a part of the deck 1 of a structure floating in a body of water 2. On the floor 3 of the body of water is situated equipment 4 is, this equipment being suspended by a rod 5 so that it rests on the sea floor 3 without exerting any appreciable pressure on the sea floor. The rod 5 is supported on the deck 1 of the floater structure by a device according to the invention generally designated 6. This device has a cross head 7 to which the rod 5 is attached, the cross head being slidably arranged in vertical guides 8 fixedly arranged in the floating structure. The cross head 7 is supported from below by two hydraulic cylinders 9*a*, 9*b*, the ends of which are pivotably attached to the deck 1 and the cross head 7, respectively. The rod 5 is furthermore guided by a pivotable guide 10 in the deck 1. The hydraulic cylinders 9*a*, 9*b* exert a tension on the rod 5 sufficient to keep the equipment 4 in the desired condition with respect to the bottom 3.

Figure 2:
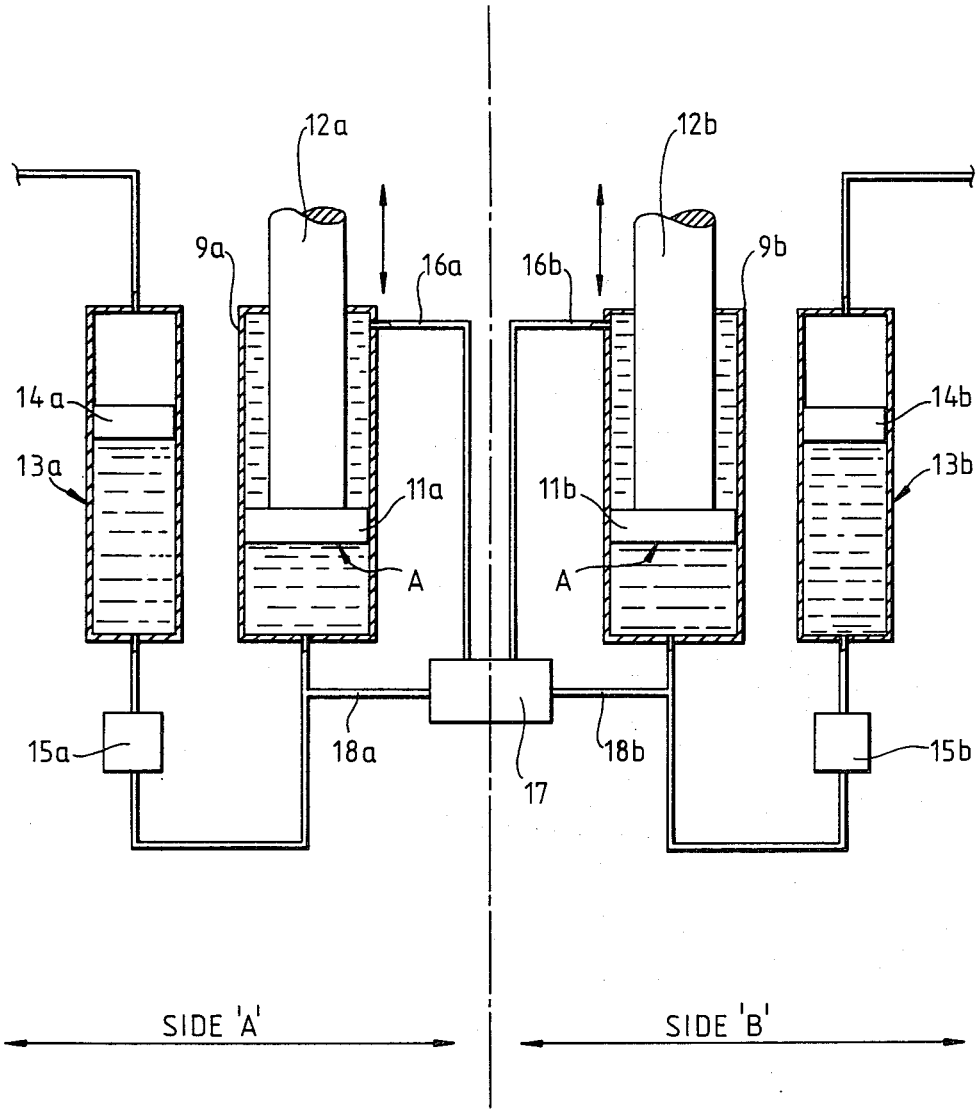
FIG. 2 is a diagramatic sketch of a device according to the invention.

FIG. 2 shows in a diagramatic way further details of the device 6. Here, the hydraulic cylinders 9*a*, 9*b* are shown with their pistons 11*a*, 11*b* and upwardly extending piston rods 12*a*, 12*b*. The bottom side of hydraulic cylinders 9*a*, 9*b* are each connected with a hydropneumatic accumulator 13*a*, 13*b* containing a slidable piston 14*a*, 14*b* separating hydraulic pressure fluid on the bottom side from a gas under pressure on the top side, the gas being supplied from a source which is not shown. The connection between the accumulator and hydraulic cylinder comprises a valve 15*a*, 15*b* whose function is to limit the flow rate to a predetermined value, however, without creating any resistance at lower flow rates. This is effective to prevent the pistons of the hydraulic cylinders from moving so fast that damage can be done if the load on the hydraulic cylinders suddenly should disappear. The valves 15*a*, 15*b* may also be used as pure block valves when the hydraulic cylinders are to be taken out or put in service.

The hydraulic cylinders 9*a*, 9*b* are each equipped with a first conduit 16*a*, 16*b* leading from the piston rod side of the pistons 11*a*, 11*b* to a valve means 17. A second conduit 18*a*, 18*b* leads from the valve means to the hydraulic cylinders on the bottom side of the pistons.

Figure 3:
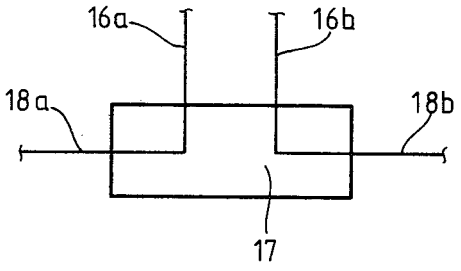
FIGS. 3–5 illustrate several possible conditions for a valve means comprised in the device in FIG. 2.
Figure 4:
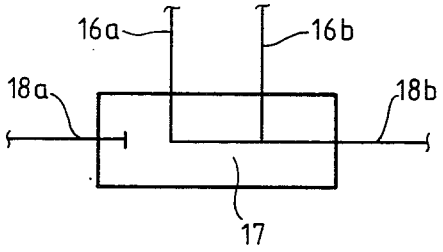
Figure 5:
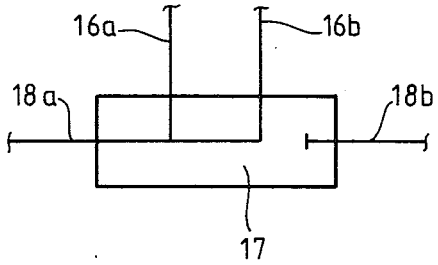

The valve means 17 shown has three possible positions as schematically suggested in FIGS. 3–5. In the normal position (FIG. 3) the valve means connects the first conduit 16*a*, 16*b* with the second conduit 18*a*, 18*b*, respectively, of the hydraulic cylinders. Thus, in this position there is a free connection between the two sides of the pistons 11*a*, 11*b* of the hydraulic cylinders. In other words, the same pressure is prevalent on both sides of each of the pistons. However, the pressure may be different in the two cylinders 9*a*, 9*b*, even though this will not usually be the case.

FIG. 4 shows another possible position of the valve means 17. Here, the second conduit 18*a* of the hydraulic cylinder 9*a* is closed, while the first conduits from the hydraulic cylinders 9*a* and 9*b* are attached with the second conduit 18*b* for the hydraulic cylinder 9*b*. With the valve means in this position, the same pressure will exist on the top side of the pistons 11*a* and 11*b* and the bottom side of piston 11*b*. FIG. 5 shows a third possible position of the valve device, the second conduit 11*b* here being closed while the first conduits 16*a*, 16*b* are attached to the second conduit 18*a* for the hydraulic cylinder 9*a*.

The valve means 17 is pressure sensitive in the sense that if it registers a deviation in the pressure in one or the other of the hydraulic cylinders exceeding a predetermined limit, it reacts by switching from normal position (FIG. 3) to one of the positions shown in FIGS. 4 and 5. If the pressure deviation takes place in the hydraulic cylinder 9*b*, the valve means 17 will move to the position shown in FIG. 4, i.e., it blocks the other conduit 18*a* for the hydraulic cylinder 9*a* and connects the first conduit 16*a* of the hydraulic cylinder 9*a* with the hydraulic cylinder 9*b*. If the error or deviation should occur in the cylinder 9*a*, the valve means 17 will switch as shown schematically in FIG. 5.

If the piston rods 12*a*, 12*b* are dimensioned so that the area of the pistons 11*a*, 11*b* on their piston rod side becomes half the area A on their bottom side, the system described above will ensure that the total pushing force from the hydraulic cylinders 9*a*, 9*b* is the same regardless of the position taken by the valve means 17. If one first considers the normal working position of the valve means 17 as shown in FIG. 3 and assumes for simplicity that the pressure P is the same in the two hydraulic cylinders 9*a*, 9*b*, one will see that the force in each of the piston rods 12*a*, 12*b* is equal to $P \times A/2$, i.e., that the total pushing force from the hydraulic cylinders is $P \times A$.

If one next assumes that the pressure in the hydraulic cylinder 9*b* falls below the predetermined limit, e.g., to a fraction P/F of the original pressure, the valve means 17 will move to the position shown in FIG. 4, i.e. the bottom side of the piston 11*a* will be subjected to a pressure P, while the top side of the piston 11*a* and both sides of the piston 11*b* will be subjected to a pressure P/F. If one calculates the total force exerted by the hydraulic cylinders, the result will be:

$$(P \times A - P/F \times A/2)_a + (P/F \times A - P/F \times A/2)_b = P \times A$$

As can be seen, the pressure fraction F does not enter into the final result, i.e., the total force from the two hydraulic cylinders remains the same regardless of how high or low the deviating pressure is.

The principle described above holds also for a cylinder number n greater than 2. One can show that if the area of the pistons on the piston rod side is made equal to the area on the opposite side divided by the number n of cylinders, on will obtain the same result if the valve means 17 is arranged to couple the cylinder with the deviant pressure to the top side of all the remaining cylinders, while the bottom sides of these cylinders are isolated. For a cylinder number n the following total force is obtained:

$$(P \times A - P \times A/n) \times n = P \times A \times (n-1)$$

If the pressure in one of the cylinders should fall to P/F, the total force becomes:

$$P \times A \times (n-1) + P/F \times A - P/F \times A/n \times n = P \times A \times (n-1)$$

Figure 6:
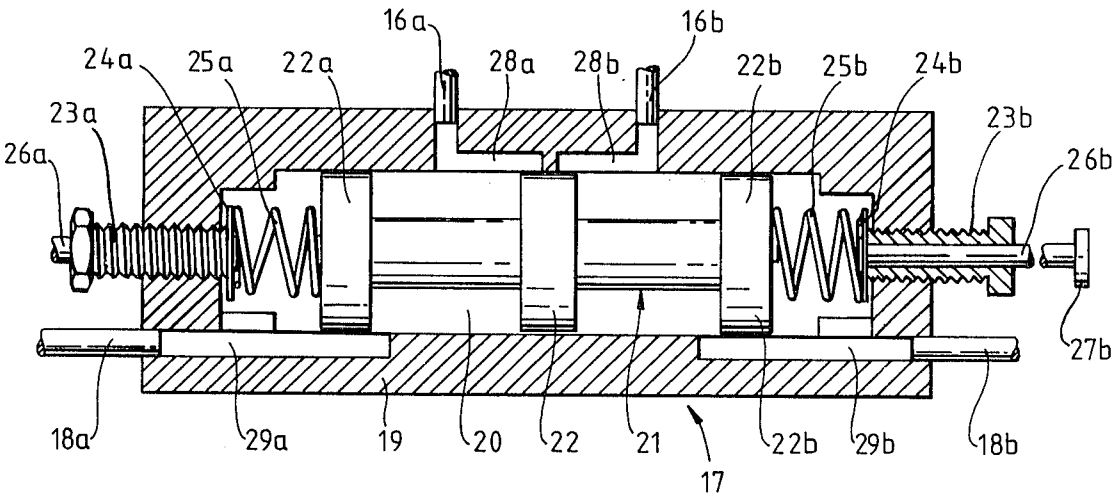
FIGS. 6 and 7 show schematic sections through a valve device in the positions shown in FIGS. 3 and 4, respectively.

FIG. 6 shows in section a schematic example of a valve means 17 which may function in the desired way. The valve means has a housing 19 having a generally cylindrical bore 20. A slidable valve element 21 is arranged in this bore, the valve element being provided with three pistons 22, 22*a* and 22*b* which seals against the wall of the cylindrical bore 20. Through each end wall of the housing 19 a screw 23*a* and 23*b* respectively extends, the screw being provided in the bore 20 with an abutment plate 24*a*, 24*b* for a spring 25*a*, 25*b*. The opposite end of the spring rests against the corresponding piston 22*a*, 22*b*. The screws 23*a*, 23*b* are provided with a axial bore which slidably and sealingly receives a rod 26*a*, 26*b* which at its outer end is provided with a disc 27*a*, 27*b* or the like for manual displacement of the rod. The housing 19 is also provided with connections for the first conduits 16*a*, 16*b* and the second conduits 18*a*, 18*b* from the hydraulic cylinders. The first conduits 16*a*, 16*b* continue in internal conduits 28*a*, 28*b* in the housing 19, while the second conduits continue in the housing in internal conduits 29*a*, 29*b*.

As shown in FIG. 6, the valve means 17 will in its normal position provide connection between the first and second conduits for each of the hydraulic cylinders 9*a*, 9*b*, while there is no connection between the hydraulic cylinders. The screws 23*a*, 23*b* and the springs 25*a*, 25*b* resting against the respective pistons 22*a*, 22*b* may be used for fine adjustment of the position of the valve element 21. The rods 26*a*, 26*b* may be used to feel the position of the valve element. The screws 23*a*, 23*b* may also be used to adjust for any minor pressure differences between the hydraulic cylinders 9*a*, 9*b*.

Figure 7:
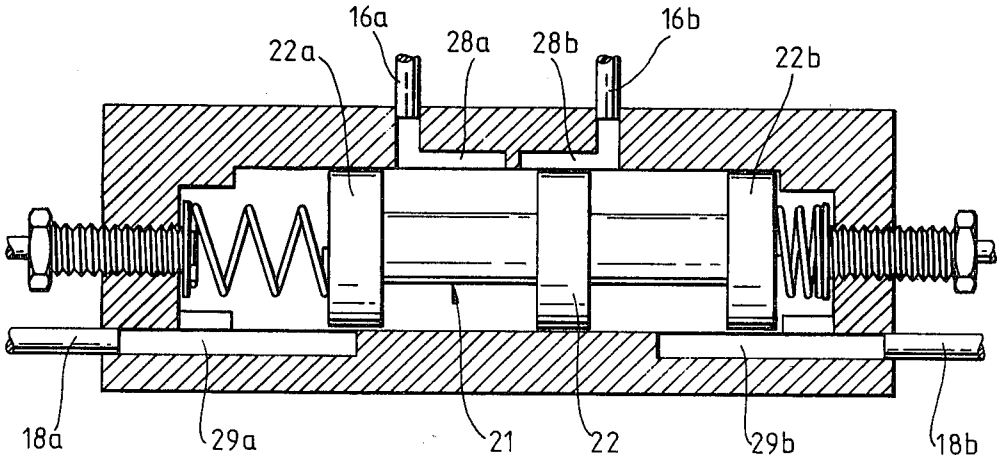

FIG. 7 shows what will happen if the pressure in the hydraulic cylinder 9*b* should fall with respect to the hydraulic cylinder 9*a*. This will result in the force on the left side of the piston 22*a* being higher than the force on the right side of the piston 22*b*, this leading to a net force which displaces the valve element 21 towards the right to the position shown in FIG. 7. Hereby the internal conduit 29*a* will be closed off from the space between the two pistons 22 and 22*a*, thus breaking the connection between the first conduit 16*a* and the second conduit 18*a* for the hydraulic cylinder 9*a*. Concurrently the motion of the piston 22 cause the spaces on its two sides to be connected to each other via the conduit 28*b*. Thus, the first conduit 16*a* is connected to the first and second conduits 16*b*, 18*b* for the hydraulic cylinder 9*b*.

It will be noted that the valve means 17 as shown in FIGS. 6 and 7 will react automatically on a change in pressure balance between the two hydraulic cylinders 9*a*, 9*b*, and that this reaction will take place without delay and with very high reliability. Furthermore, it will be noted that the valve means has a very simple design requiring a minimum of maintenance and is simple to test functionally.

The invention is described above in connection with a supporting device utilizing two hydraulic cylinders. However, the invention is valid for any number of cylinders, and in practice a number of three or four will probably be the most advantageous. When the number of cylinders is increased, the diameter of the piston rod will increase relative to the piston diameter, so that the hydraulic cylinders may be built for larger strokes without the risk of buckling of the piston rod. If an even number of cylinders is used, it will be advantageous to arrange these in pairs which each makes use of a valve means as suggested in FIGS. 6 and 7.

I claim:

1. A device for supporting equipment (4, 5) on a floating structure, said equipment preferably extending between the structure (1) and the ocean floor (3), comprising at least two hydraulic cylinders (9*a*, 9*b*) which are arranged between the structure and the equipment and which are connected to a source of hydraulic pressure fluid, characterized in that it further comprises a valve means (17) which for each of the hydraulic cylinders (9*a*, 9*b*) is connected to the respective hydraulic cylinder (9*a*, 9*b*) on the piston rod side of its piston (11*a*, 11*b*) via a first conduit (16*a*, 16*b*) and via a second conduit (18*a*, 18*b*) is connected with the hydraulic cylinder (9*a*, 9*b*) on the opposite side of the piston (11*a*), the valve means (17) being arranged to connect said first and second conduits (16*a*, 16*b*; 18*a*, 18*b*) for each hydraulic cylinder (9*a*, 9*b*) under normal pressure conditions and under deviant pressure conditions in one hydraulic cylinder (9*a*, 9*b*) to break the connection between said first and second conduits (16*a*, 16*b*; 18*a*, 18*b*) for the remaining hydraulic cylinders (9*a*, 9*b*) and connect the first conduits (16*a*, 16*b*) for these with the first and second conduits (16*a*, 16*b*; 18*a*, 18*b*) of the deviant hydraulic cylinder (9*a*, 9*b*), and in that the area of the piston (11*a*, 11*b*) of each hydraulic cylinder (9*a*, 9*b*) on the piston rod side is equal to the piston area (A) on the opposite side divided by the number of hydraulic cylinders (9*a*, 9*b*) connected to the valve means (17).

2. A device according to claim 1, characterized in that the valve means (17) is arranged to break said connection when the pressure in the deviant hydraulic cylinder (9*a*, 9*b*) falls below a predetermined value relative to the pressure in the remaining hydraulic cylinders (9*b*, 9*a*).

3. A device according to claim 2, characterized in that the valve means (17) is provided with means (23*a*, 24*a*; 23*b*, 24*b*) for compensating for a pressure difference between the hydraulic cylinders (9*a*, 9*b*).

4. A device according to claim 2 and 3, characterized in that the valve means (17) is provided with means (26*a*; 26*b*) for manually influencing a valve element (21) in the valve means (17) and feeling the position of the valve element (21).

* * * * *